US005150744A

United States Patent [19]

Hayashi et al.

[11] Patent Number: 5,150,744

[45] Date of Patent: Sep. 29, 1992

[54] MOORING APPARATUS

[75] Inventors: Nobuharu Hayashi, Kobe; Hiroji Tanaka, Funabashi, both of Japan

[73] Assignees: Sumitomo Rubber Industries, Ltd.; Penta-Ocean Construction Co., Ltd., Tokyo, Japan

[21] Appl. No.: 679,395

[22] Filed: Apr. 2, 1991

[30] Foreign Application Priority Data

Apr. 3, 1990 [JP] Japan ..... 2-35454

[51] Int. Cl.[5] ..... B63B 21/00

[52] U.S. Cl. ..... 114/230; 114/219

[58] Field of Search ..... 114/293, 230, 219, 220; 403/212-215

[56] References Cited

U.S. PATENT DOCUMENTS 2,844,943 7/1958 Kennedy ..... 114/220

4,008,678 2/1977 Lawlor ..... 114/230

4,066,030 1/1978 Milone ..... 114/230

FOREIGN PATENT DOCUMENTS 1234280 5/1986 U.S.S.R. ..... 114/230

1351989 11/1987 U.S.S.R. ..... 405/212

*Primary Examiner*—Edwin L. Swinehart

*Attorney, Agent, or Firm*—Nikaido, Marmelstein, Murray & Oram

[57] ABSTRACT

A pair of sliding members mounted on the broadside are vertically and slidably engaged with engagement members disposed in a pair of dolphins. The engagement members can freely move in a horizontal direction. The dolphins are provided with fenders which receive the engagement members by elastic force to absorb the rocking of a ship in forward and backward directions, and in right and left broadside directions.

6 Claims, 4 Drawing Sheets

MOORING APPARATUS

BACKGROUND OF THE INVENTION

The present invention relates to an apparatus for mooring a ship.

Mooring apparatuses shown in FIGS. 6 and 7 moor the ship which is to be used as a restaurant, a hotel or the like in a harbor or in the vicinity of a quay for a long period of time.

The mooring apparatus shown in FIG. 6 comprises a plurality of dolphins 90, 91 and 92, chains 93, and buffer fenders 94. The dolphins 90 are disposed beside right and left broadsides S1 and S2 of a ship S. The dolphins 91 and 92 are respectively placed on certain positions apart from the stem and stern at predetermined distances. The chains 93 connect the stem and stern to the dolphins 91 and 92. The features 94 are provided on the faces of the dolphins 90 which are opposed to the broadsides S1 and S2.

The mooring apparatus shown in FIG. 7 comprises a pair of dolphins 95, a pair of sliding members 96 and engagement members 97. The dolphins 95 are disposed beside a broadside S1 of a ship S. The sliding members 96 are fixed to the broadside S1. The engagement members 97 are fixed to the dolphins 95. The dolphins 95 are vertically and slidably engaged with the sliding members 96 by the engagement members 97.

The mooring apparatus shown in FIG. 6 is large-sized and the cost of construction is increased due to a lot of dolphins 90, 91 and 92 and the chains 93 for mooring the ship S. Furthermore, a wide sea area is required to moor the ship. Thus, the mooring apparatus cannot be used in the narrow harbor.

Whilst the mooring apparatus shown in FIG. 7 can moor the ship S against the rocking force in a vertical direction, cannot do it in forward and backward directions and in right and left broadside directions. Consequently, the mooring apparatus cannot be used for a large-sized ship or the sea area in which waves are high due to the load strongly applied on the apparatus by the rocking force of the ship S.

OBJECT AND SUMMARY OF THE INVENTION

It is an object of the present invention to provide a mooring apparatus wherein a lot of dolphins are not needed and the cost of construction is low.

It is another object of the present invention to provide a mooring apparatus which can also be used in a narrow sea area.

It is yet another object of the present invention to provide a mooring apparatus which can also be used for a large-sized ship and used in the sea area in which waves are high.

To achieve the above-mentioned objects, the mooring apparatus comprises a pair of sliding members mounted on positions of a broadside with a predetermined distance in forward and backward directions of the broadside, engagement members for slidably engaging with the sliding members in a vertical direction, dolphins for holding the engagement members so as to move freely in a horizontal direction, first buffer means disposed on at least one of the dolphins for receiving the enggement member held on the dolphin by the elastic force so as to absorb the forward rocking of a ship, second buffer means disposed on the other dolphin for receiving the engagement member held on the dolphin by the elastic force so as to absorb the backward rocking of the ship, and third buffer means disposed on the dolphins for receiving the engagement members held on the dolphins by the elastic force and preventing the engagement members from leaving in a broadside direction beyond a predetermined distance by the elastic force so as to absorb the rocking of the ship in the right and left broadside directions.

According to the above-mentioned mooring apparatus, the ship is moored at the dolphins by the pair of sliding members mounted on the broadsides and engagement members engaging with the sliding members. The engagement members allow the sliding members to slide in the vertical direction. Consequently, the ship can be allowed to move in the vertical direction owing to the waves and tides.

The forward and backward rocking of the ship can be absorbed by the first buffer means disposed on at least one of the dolphins and the second buffer means disposed on the other dolphin. In addition, the rocking of the ship in the right and left broadside directions can be absorbed by the third buffer means disposed on each dolphin.

In the mooring apparatus mentioned above, the first and second buffer means may take in the form of fenders. According to this manner, the structure of the buffer means can be simplified. Furthermore, the good buffering action can be maintained for a long period of time.

The third buffer means may include a fender and a connection member for separately connecting the engagement member to the fender. According to this manner, the structure of the third buffer means can be simplified. Furthermore, the good buffering action can be maintained for a long period of time.

In the third buffer means which includes the fender and the connection member, the fender may have a first contact member which comes into contact with the engagement member, a second contact member which comes into contact with the dolphin, and a rubber buffer which is provided between the first and second contact members. In this case, the connection member may penetrate the first contact member so as to be connected to the second contact member. According to this manner, the structure of the third buffer means can further be simplified.

The connection member may penetrate the second contact member so as to be connected to a stopper which can be contact with or separate from the second contact member. According to this manner, the third buffer means can be small-sized.

It is preferable to provide an elastic member between the stopper and the second contact member. According to this manner, the elastic member can absorb the shocks when the stopper comes into contact with the second contact member.

DETAILED DESCRIPTION OF THE PREFERRED EMBODIMENT

A preferred embodiment of the present invention will be described in detail with reference to the drawings.

Figure 1:
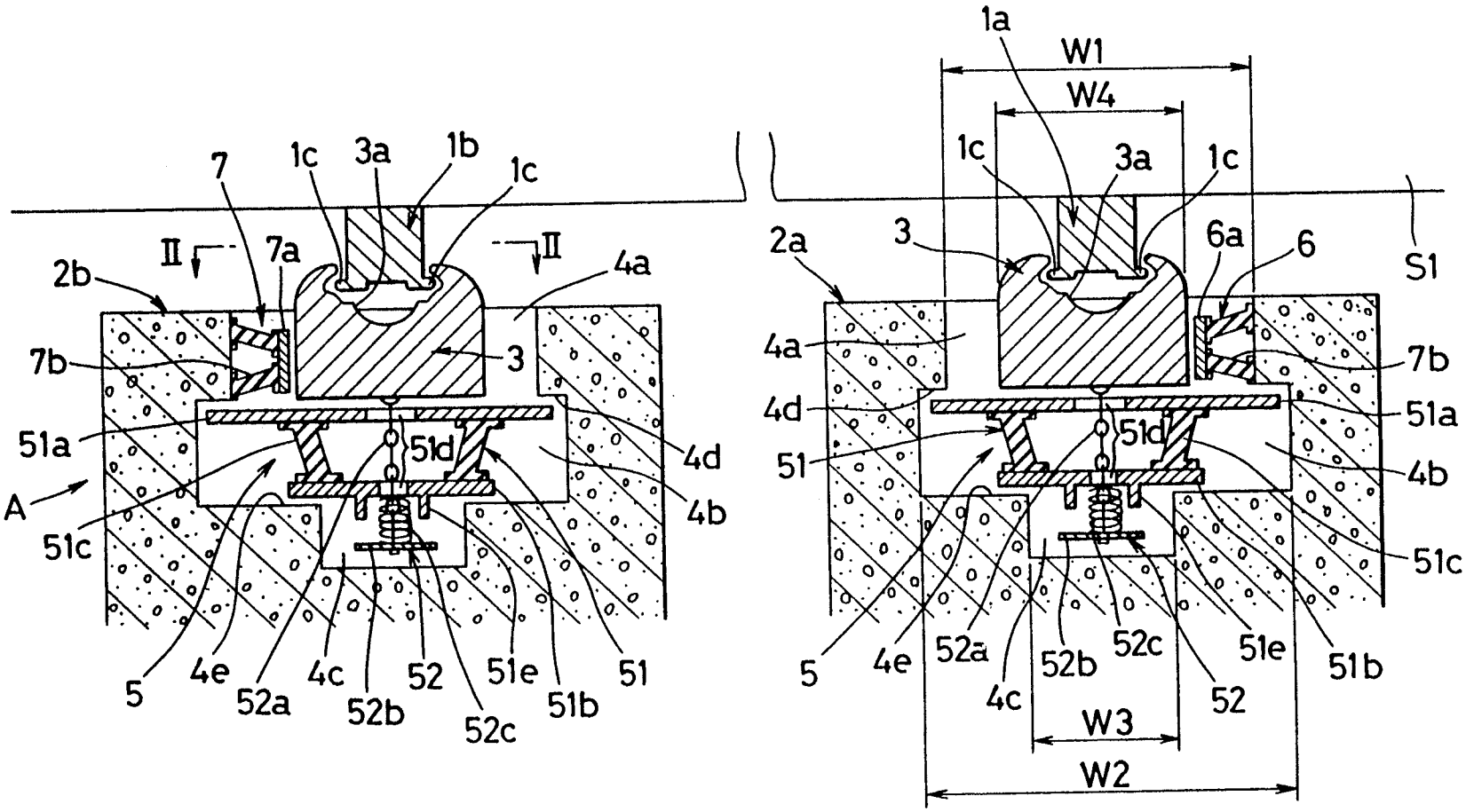
FIG. 1 is a section view showing an embodiment of a mooring apparatus according to the present invention.
Figure 4:
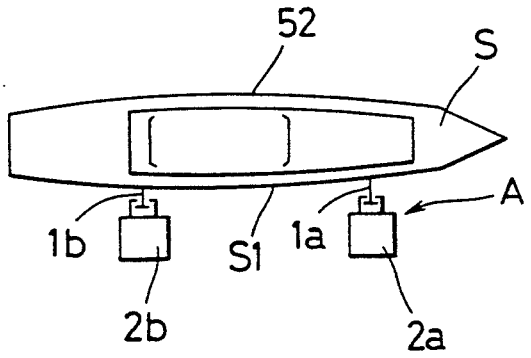
FIG. 4 is a schematic plan view of the mooring apparatus according to the present invention.
Figure 5:
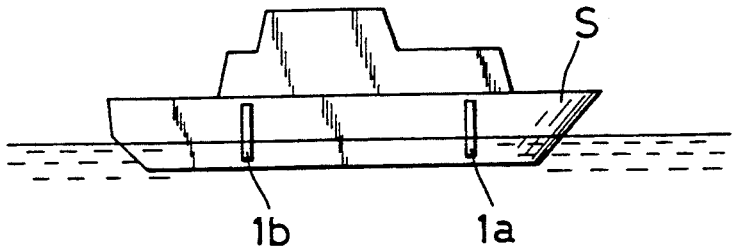
FIG. 5 is an elevation view of the ship which is provided with guide members.

FIG. 1 is a section view of a mooring apparatus according to the present invention. The mooring apparatus A moors sliding members 1*a* and 1*b* mounted on a broadside S1 of a ship S by dolphins 2*a* and 2*b*. The sliding members 1*a* and 1*b* are placed with a predetermined distance in a front and back direction of the broadside S1 (see FIG. 4). The sliding members 1*a* and 1*b* are rectangular parallelepiped and are fixed on the broadside S1 with longer sides thereof turned in a vertical direction (see FIG. 5). The sliding members 1*a* and 1*b* have top portions forming engagement portions 1*c* for engaging with engagement members 3 disposed in the dolphin 2*a* and 2*b*. The engagement portions 1*c* project from opposite sides of the sliding members 1*a* and 1*b* in right and left directions of FIG. 1.

The dolphins 2*a* and 2*b* have conventional structure in which a lot of concrete piles are driven in the sea bottom and have their heads connected to reinforced concrete.

Figure 2:
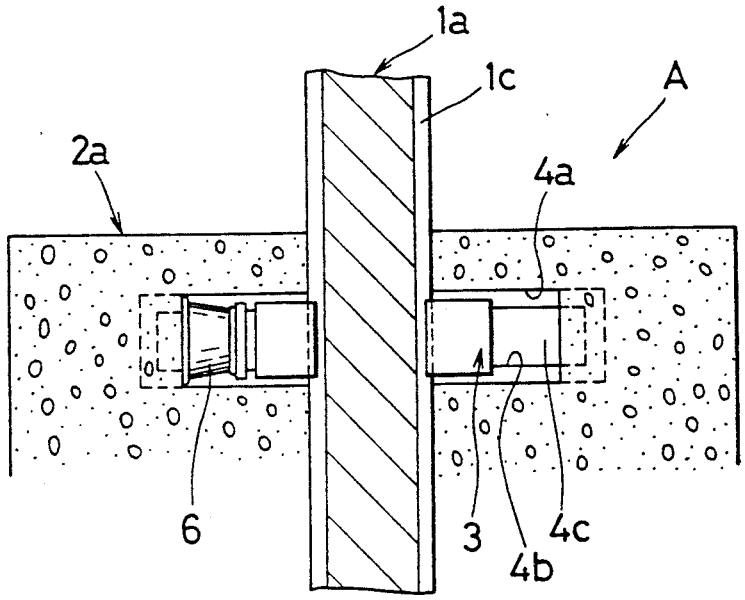
FIG. 2 is a section view taken along the line II—II in FIG. 1.
Figure 3:
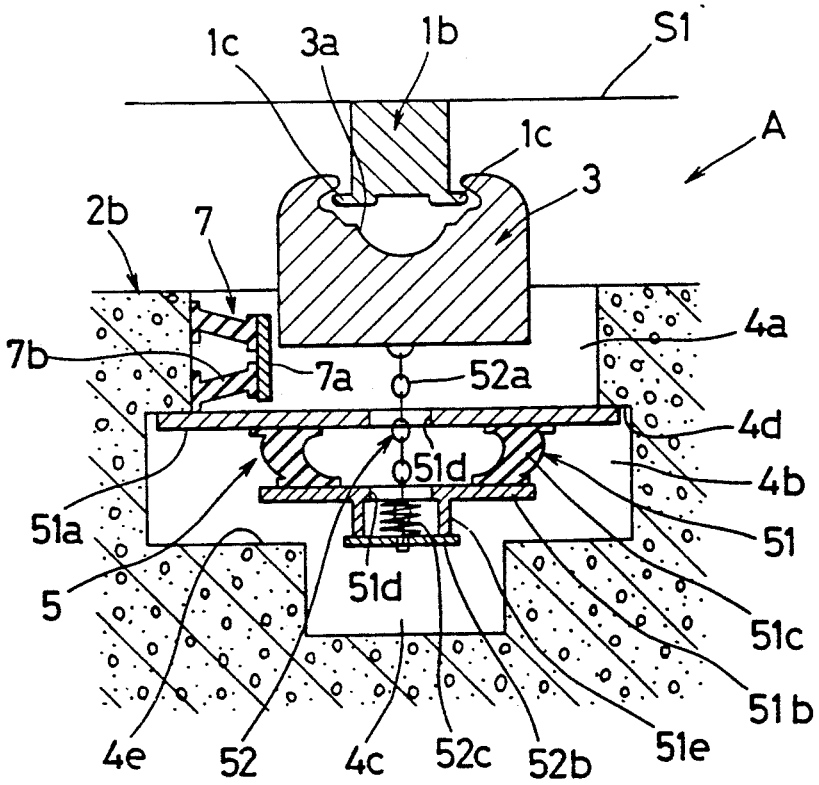
FIG. 3 is a section view of the mooring apparatus showing the state where a ship moves in a direction apart from dolphins.

The dolphins 2*a* and 2*b* have heads forming first spaces 4*a* for disposing the engagement members 3. The first spaces 4*a* have inner portions forming second spaces 4*b*. The second spaces 4*b* have inner portions forming third spaces 4*c*. The spaces 4*a*, 4*b* and 4*c* have the shape of rectangular parallelepiped which extends in the right and left direction of FIG. 2. A width W1 of the first space 4*a* (a horizontal length of FIG. 1) is sufficiently longer than a width W4 of the engagement member 3. A width W2 of the second space 4*b* is longer than the width W1 of the first space 4*a* and a width W3 of the third space 4*c*.

The engagement member 3 is movably disposed in the first space 4*a* in the horizontal direction (in directions of the stem, stern, and right and left broadsides of the ship S). A first fender 6 is disposed in the first space 4*a* of the dolphin 2*a* fixed on the front of the broadside S1. The first fender 6 serves as first buffer means for elastically receiving the engagement member 3 moved toward the stem side. A second fender 7 is disposed in the first space 4*a* of the dolphin 2*b* fixed on the back of the broadside S1. The second fender 7 serves as second buffer means for elastically receiving the engagement member 3 moved toward the stern side. Third buffer means 5 are disposed in the second spaces 4*b* of the dolphins 2*a* and 2*b*. The third buffer means 5 receives the engagement member 3 moved in an opposite direction of broadside S1 (downward of FIG. 1) and prevents the engagement member 3 from projecting from the first space 4*a* beyond a predetermined amount.

The engagement members 3 have a portions opposite to the broadside S1 in which are formed engagement grooves 3*a* fitted therein the engagement portions 1*c* of the sliding members 1*a* and 1*b*. The engagement grooves 3*a* allow the sliding members 1*a* and 1*b* to move in the vertical direction and restrict their separation from the engagement members 3.

The first and second fenders 6 and 7 include contact members 6*a* and 7*a* being in contact with the engagement members 3, and rubber buffers 6*b* and 7*b* which are integrally formed with the contact members 6*a* and 7*a*. The first and second fenders 6 and 7 may be formed in an annular or rectilinear shape. In any case, the existing fenders can be used. The fenders 6 and 7 can receive the engagement members 3 with the simple structure and good buffering action.

The third buffer means 5 includes a third fender 51 and a connection member 52 for separately connecting the engagement member 3 to the third fender 51. The third fender 51 has first and second contact members 51*a* and 51*b* formed of metal plate, and a rubber buffer 51*c* which is integrally provided between the first and second contact members 51*a* and 51*b*. The first contact member 51*a* comes into contact with the engagement member 3 and a side wall 4*d* on the broadside S1 side of the second space 4*b*. The second contact member 51*b* comes into contact with a side wall 4*e* on the inner part side of the second space 4*b*. The connection member 52 has a chain 52*a* for connecting the engagement member 3 to the second contact member 51*b*. The chain 52*a* passes through holes 51*d* respectively formed in the first and second contact members 51*a* and 51*b*. One end of the chain 52*a* is connected to a stopper 52*b* disposed in the third space 4*c*. The stopper 52*b* is formed of a metal disk and comes into contact with cylinders 51*e* formed on the second contact member 51*b* so as to prevent the engagement member 3 from projecting from the first space 4*a* beyond the predetermined amount. A compression coil spring 52*c* as an elastic member is disposed between the stopper 52*b* and the second contact member 51*b*. The chain 52*a* is passing through the center of the compression coil spring 52*c* which absorb the shocks when the stopper 52*b* comes into contact with the second contact member 51*b* so that the compression coil spring 52*c* prevent the strong shocks which may apply on the chain 52*a*.

Acccording to the mooring apparatus having the abovementioned structure, because the sliding members 1*a* and 1*b* fixed on the broadside S1 are vertically movably engaged with the engagement members 3 disposed in the dolphins 2*a* and 2*b*, the ship S can be allowed to rock in the vertical direction owing to the waves and tides.

In the case where the ship S rocks forwardly, the engagement member 3 will move forwardly according to the rocking. When the ship S moves to some extent, the engagement member 3 is received by elastic force of the first fender 6 with the good buffering action. Consequently, the forward movement is stopped. Thus, the first fender 6 can absorb the forward rocking of the ship S.

In the case where the ship S rocks backwardly, the engagement member 3 will move backwardly according to the rocking. When the ship S moves to some extent, the engagement member 3 is received by the elastic force of the second fender 7 with the good buffering action. Consequently, the backward movement is stopped. Thus, the second fender 7 can absorb the backward rocking of the ship S.

In case where the ship S rocks in the right broadside direction, the sliding members 1*a* and 1*b*, and therefore the engagement members 3, will move toward the third fenders 5. When the engagement members 3 come into contact with the first contact members 51*a* of the third fenders 5 and then the second contact member 51*b* come into contact with the side walls 4*e*, the movement of the engagement members 3 is stopped by the elastic force of the third fenders 51 with the good buffering action. Thus, the third fenders 5 can abosrb the rocking of the ship S in the right broadside direction.

In the case where the ship S rocks in the left broadside direction, the sliding members 1*a* and 1*b*, and therefore the engagement members 3, will move apart from the third fenders 5. When the engagement members 3 move to some extent, the stoppers 52*b* are pulled by the chains 52*a* so as to come into contact with the cylinders 51*e* of the second contact members 51*b*. When the first contact members 51*a* then come into contact with the side walls 4*d* of the second spaces 4*b*, the movement of the engagement members 3 is stopped by the third fenders 51 with the good buffering action. Thus, the third fenders 5 can also absorb the rocking of the ship S in the left broadside direction.

According to the above-mentioned embodiment, although the first fender 6 for absorbing the forward rocking of the ship S is disposed on the front dolphin 2*a*, and the second fender 7 for absorbing the backward rocking of the ship S is disposed on the back dolphin 2*b*, the first and second fenders 6 and 7 may be disposed on the back and front dolphins 2*b* and 2*a*, respectively. In addition, the first and second fenders 6 and 7 may be disposed on the front and back dolphins 2*a* and 2*b*, respectively.

Furthermore, leaf springs or coil springs can be used as the buffer means in place of the fenders 5, 6 and 7.

Figure 6:
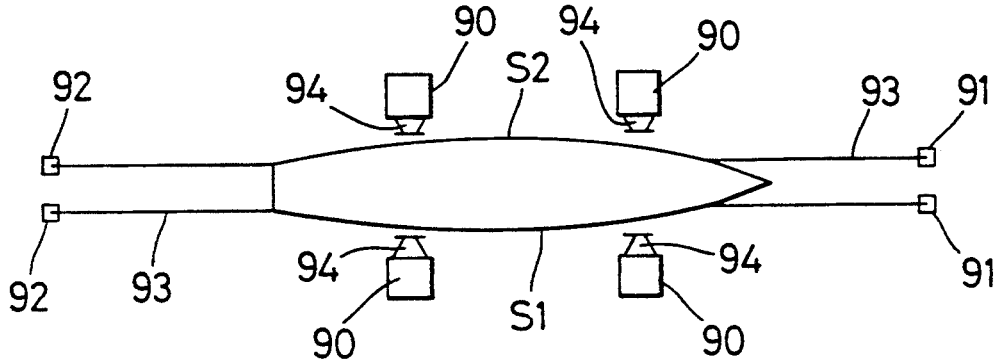
FIGS. 6 and 7 are schematic plan views showing conventional mooring apparatuses.
Figure 7:
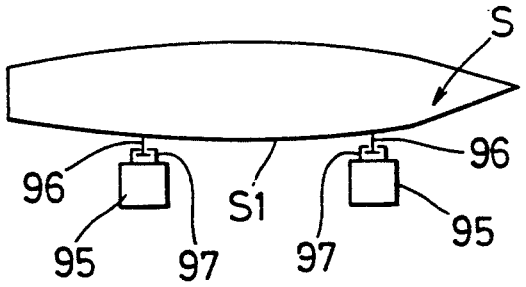

According to the mooring apparatus having the abovementioned structure, the number of the dolphins is smaller as compared with a conventional mooring apparatus shown in FIG. 6. Consequently, the cost of construction can be reduced. In addition, it is not required to use long chains for mooring the stem and stern, the occupancy area of the sea is reduced, so that the mooring apparatus can be used in a narrow harbor. Furthermore, the buffer means can absorb the rocking well in forward and backward directions, and in right and left broadside directions. Consequently, the mooring apparatus can fully be used in the large-sized ship and the sea area in which the waves are high.

What is claimed is:

1. A ship mooring apparatus, comprising:

first and second sliding members secured to a side of a ship, said sliding members being vertically disposed and having a predetermined space therebetween;

first and second dolphins securely disposed adjacent to said ship, and corresponding to said sliding members;

first and second engagement means horizontally movably disposed in said first and second dolphins, respectively, said engagement means for slidably engaging said sliding members in a vertical direction;

first buffer means disposed on said first dolphin, for elastically contacting said first engagement member, thereby absorbing a forward rocking of said ship;

said second buffer means secured to said second dolphin, for elastically contacting said second engagement member, thereby absorbing a backward rocking of said ship; and third buffer means disposed on said first and second dolphins for elastically contacting said first and second engagement members, respectively, wherein said third buffer means prevents said first and second engagement members from moving beyond a predetermined distance in right and left lateral directions.

2. A mooring apparatus according to claim 1, wherein said first and second buffer means comprise fenders.

3. A mooring apparatus according to claim 1, wherein said third buffer means includes a fender and a connection member for separatably connecting said engagement means to said fender.

4. A mooring apparatus according to claim 3, wherein said fender of said third buffer means on each of said dolphins includes a first contact member which comes into contact with said engagement means, a second contact member which comes into contact with the dolphin, and a rubber buffer means disposed between said first and second contact members, said connection member penetrating said first contact member and connected to the second contact member.

5. A mooring apparatus according to claim 4, wherein said connection member penetrates said second contact member so as to be connected to a stopper which moves into and out of contact with said second contact member.

6. A mooring apparatus according to claim 5, wherein elastic means is disposed between said stopper and said second contact member for absorbing shocks when the stopper comes into contact with said second contact member.

* * * * *